US007997821B2

(12) United States Patent
Saitou

(10) Patent No.: US 7,997,821 B2
(45) Date of Patent: Aug. 16, 2011

(54) STICK-SHAPED ARTICLE PROPELLING CONTAINER

(75) Inventor: Juri Saitou, Kawagoe (JP)

(73) Assignee: Kotobuki & Co. Ltd., Kawagoe-shi (JP)

( * ) Notice: Subject to any disclaimer, the term of this patent is extended or adjusted under 35 U.S.C. 154(b) by 314 days.

(21) Appl. No.: 12/299,370

(22) PCT Filed: Jan. 16, 2008

(86) PCT No.: PCT/JP2008/050836

§ 371 (c)(1),
(2), (4) Date: Apr. 2, 2009

(87) PCT Pub. No.: WO2008/111328

PCT Pub. Date: Sep. 18, 2008

(65) Prior Publication Data

US 2010/0021227 A1 Jan. 28, 2010

(30) Foreign Application Priority Data

Mar. 9, 2007 (JP) ..... 2007-059349

(51) Int. Cl.
*B43K 21/02* (2006.01)
*B43K 21/22* (2006.01)

(52) U.S. Cl. ..... 401/92; 401/55; 401/65

(58) Field of Classification Search ..... 401/53, 401/55, 65, 82, 83, 88, 92–95
See application file for complete search history.

(56) References Cited

U.S. PATENT DOCUMENTS 4,140,408 A * 2/1979 Mizutani ..... 401/65
4,371,277 A * 2/1983 Kageyama et al. ..... 401/65
6,758,617 B2 * 7/2004 Sakaoka ..... 401/92

* cited by examiner

*Primary Examiner* — Tuan N Nguyen
(74) *Attorney, Agent, or Firm* — Rothwell, Figg, Ernst & Manbeck, P.C.

(57) ABSTRACT

Variations in the size of a stick-like object are accommodated, and abutments are urged to contact with the stick-like object with an appropriate pressure.

A stick-like object feeding container is provided with: an outer sleeve 11 having a front spring shoe 11*a* formed on the internal circumference of the front portion of the outer sleeve; an inner sleeve 12 slidably inserted into the outer sleeve and having a rear spring shoe 12*a* provided on the outer circumference of the inner sleeve; a spring 13 abutting at its front and rear ends against the front spring shoe and the rear spring shoe, respectively, to bias the inner sleeve backward; a chuck 17 adapted to be capable of gripping, by its front end portion, the stick-like object inserted into the inner sleeve; and a chuck ring 18. A ring member 21 is interposed between the front end of the spring 13 and the front spring shoe 11*a*; elastic pieces 22 extending along the stick-like object are linked at the rear end to the ring member; abutments 23 are formed on the front end of the elastic pieces; and the elastic pieces 22 are configured to elastically urge the abutments to contact with the stick-like object. The inner sleeve or chuck having fitted thereon the ring member is provided with engaging pieces for preventing the ring member from moving forward movement.

4 Claims, 7 Drawing Sheets

STICK-SHAPED ARTICLE PROPELLING CONTAINER

CROSS REFERENCE TO RELATED APPLICATION(S)

This application is a 35 U.S.C. §371 National Phase Entry Application from PCT/JP2008/050836, filed Jan. 16, 2008, and designating the United States and also claims the benefit of Japanese Patent Application No. 2007-059349, filed Mar. 9, 2007, the disclosures of which are incorporated herein in their entirety by reference.

TECHNICAL FIELD

The present invention relates to a container having accommodated therein a stick-like object such as an eraser shaft, pencil lead shaft, crayon pencil shaft, pastel pencil shaft or eyebrow pencil shaft. More particularly, the invention relates to a stick-like object feeding container capable of feeding out from its front end such a stick-like object and retracting it after use.

BACKGROUND ART

Conventionally, there is known a stick-like object feeding container capable of feeding out a stick-like object such as an eraser shaft, pencil lead shaft, crayon pencil shaft, pastel pencil shaft or eyebrow pencil shaft from its front end and retracting it after use (see, for example, Utility Model Application Publication No. 3-44552). This stick-like object feeding container is provided with: an outer sleeve having a front spring shoe formed in the interior surface of the front portion thereof; an inner sleeve slidably inserted into the outer sleeve; a spring for biasing the inner sleeve backward; a chuck provided on the front end of the inner sleeve and adapted to grip the stick-like object inserted into the inner sleeve by its front end portion; a chuck ring fitted onto the chuck and locked to the front end of the outer sleeve; and abutments for contact with the stick-like object inserted in the inner sleeve.

This stick-like object feeding container is designed so that upon moving the inner sleeve forward in the axial direction thereof against the biasing force of the spring with the outer sleeve held by hand, the chuck provided at the front end of the inner sleeve opens under the action of the chuck ring, thereby allowing the stick-like object to be fed out forward. Further, the abutments are always in contact with the stick-like object by the frictional resistance therebetween to prevent the stick-like object from falling off when the chuck is opened and to prevent the fed-out stick-like object from retracting when the inner sleeve moves backward and the chuck returns from the opened state to the closed state.

On the other hand, the stick-like object fed out forward could be retracted by moving the inner sleeve forward in axial direction against the biasing force of the spring to open the chuck, and pushing the stick-like object at the front end backward against the frictional resistance caused by the contact of the abutments with the stick-like object.

DISCLOSURE OF THE INVENTION

Problem to be Solved by the Invention

In the above-described conventional stick-like object feeding container, however, the abutments for contact with the stick-like object are formed integrally with the outer sleeve. In this instance, the outer sleeve is held by hand, and hence it is constructed from a relatively rigid resin or metal. Accordingly, the abutments formed integrally with such a rigid outer sleeve will not deform, and when the stick-like object happens to be too big due to variations in size, the abutments will bite into the stick-like object, causing flaws on its outer surface. In such an instance, when the stick-like object is fed out, a defect that the flaws caused on the stick-like object will show up on the exterior and hence spoil the external appearance of the stick-like object. Conversely, when the stick-like object is too small, the frictional resistance caused by the contact of the abutments with the stick-like object will decrease, resulting in defects such as the latter falling out upon opening of the chuck, or retracting upon returning of the chuck from its opened to closed state.

To obviate such defects, there is proposed a structure in which the outer sleeve is provided with U-shaped slits at opposite positions and abutments are formed on the interior surfaces of the front ends of the elastic pieces formed by the slits so that variations in the size of the stick-like object may be accommodated by the flexibility of the elastic pieces. Since the U-shaped slits provided in the outer sleeve are visible directly from outside, there still remains a problem yet to be solved that the external appearance of the container is seriously spoiled by forming the slits. In addition, there was a problem that no elastic pieces with flexibility can be obtained by forming the slits in the outer sleeve which is constructed from a relatively rigid resin.

An object of the present invention is to provide a stick-like object feeding container that accommodates varying sizes of the stick-like object to allow the abutments to contact with the stick-like object with an appropriate pressure.

Means for Solving the Problem

The invention according to claim 1 is an improvement in a stick-like object feeding container 10 that comprises, as shown in FIG. 1: an outer sleeve 11 having a front spring shoe 11*a* formed on the interior surface of the front portion of the outer sleeve; an inner sleeve 12 slidably inserted into the outer sleeve 11 and having a rear spring shoe 12*a* formed on the outer circumference of the inner sleeve at a position backward of the front spring shoe 11*a*; a spring 13 abutting at the front and rear ends against the front and rear spring shoes 11*a* and 12*a*, respectively, to bias the inner sleeve 12 backward; a chuck 17 provided at the front end of the inner sleeve 12 to grip the front end portion of the stick-like object 16 inserted into the inner sleeve 12; a chuck ring 18 roughly fitted onto the chuck 17 and disposed around the front end of the outer sleeve 11; and abutments 23 for contact with the stick-like object 16 inserted into the inner sleeve 12.

The structural feature of the above container resides in that: a ring member 21 is interposed between the front end of the spring 13 and the front spring shoe 11*a*; elastic pieces 22 extending along the stick-like object 16 are linked at their rear ends to the ring member 21; the abutments 23 are formed at the front end of the elastic pieces 22; and the elastic pieces 22 are configured to elastically urge the abutments 23 to contact with the stick-like object.

In the stick-like object feeding container recited in claim 1, the abutments 23 for contact with the stick-like object 16 are formed integrally with the ring member 21 and the elastic pieces 22 provided separately of the outer sleeve 11. Accordingly, even if the outer sleeve 11 is formed of resin or metal of a relatively high rigidity, the abutments 23 could be urged to contact with the stick-like object with an appropriate pressure by constructing the ring member 21 and the elastic pieces 22 from appropriately elastic resin or the like.

Further, since the elastic pieces 22 elastically urge the abutments 23 to contact with the stick-like object, variations in the size of the stick-like object 16 for each lot could be accommodated by the flexibility of the elastic pieces 22, enabling the abutments 23 to be urged to contacted with the stick-like object with an appropriate pressure at all times.

Moreover, since the elastic pieces 22 are formed on the ring member 21 which is inserted into the outer sleeve 11 independently of the outer sleeve 11, there is no need for forming slits or the like in the outer sleeve to form elastic pieces as in the prior art. This effectively precludes the possibility of seriously spoiling the external appearance.

An invention of claim 2 is an invention according to claim 1, characterized by such a configuration as shown in FIG. 2 in which the inner sleeve 12 or chuck 17 having fitted thereon the ring member 21 includes engaging pieces 24 for preventing the ring member 21 from moving forward.

To assemble this stick-like object feeding container, the ring member 21 and the spring 13 are inserted into the outer sleeve 11; in the case of the stick-like object feeding container recited in claim 2, the spring 13 is fitted on the chuck 17 and then the ring member 21 is fitted onto the chuck from the front thereof to engage the ring member 12 with the engaging pieces 24, by which the ring member 21 can be held around the chuck 17 along with the spring 13. Accordingly, the spring 13 and the ring member 21 form a one-piece structure with the chuck 17, hence enabling them to be inserted into the outer sleeve 11 in a single step. As the result of this, the stick-like object feeding container can be assembled relatively easily.

An invention of claim 3 is an invention according to claim 1, characterized by such a configuration as shown in FIG. 3 in which the chuck 17 comprises a plurality of gripping pieces 17*a*, 17*a*, the engaging pieces 24 are formed on each of the gripping pieces 17*a*, 17*a*, and the ring member 21 is disengaged from the engaging pieces 24 by the movement of the gripping pieces 17*a*, 17*a* toward each other.

In the case of the stick-like object feeding container recited in claim 3, as the ring member 21 is fitted on the chuck 17 from the front thereof after the spring 13 was fitted thereon, the plurality of gripping pieces 17*a*, 17*a* move toward each other, allowing the ring member 21 to move over the engaging pieces 24 in the backward direction as shown in FIG. 3. On the other hand, when the gripping pieces 17*a*, 17*a* return to their initial states after the ring member 21 has been moved over the engaging pieces 24, the engaging pieces 24 engage with the ring member 21 as shown in FIG. 2, inhibiting the ring member 21 from moving forward. Accordingly, the ring member 21 can be locked by the engaging pieces 24 through a relatively simple work which needs only to fit the ring member 21 onto the chuck 17 from the front thereof after fitting thereon the spring 13.

An invention of claim 4 is an invention according to claim 3, characterized by a configuration in which projections 21*b* protruding forward are provided on the marginal edges of the hole of the ring member 21, and recesses 24*a* with which the projections 21*b* engage, are formed in the engaging pieces 24 so that an engagement of the projections 21*b* with the recesses 24*a* prevents the gripping pieces 17*a*, 17*a* from moving toward each other.

In the case of the stick-like object feeding container recited in claim 4, since an engagement of the projections 21*b* with the recesses 24*a* prevent the gripping pieces 17*a*, 17*a* from moving toward each other, it is possible to exclude the possibility of releasing the ring member 21 from the state of being locked by the engaging pieces 24 due to accidental movement of the gripping pieces 17*a*, 17*a* toward each other. This enables the spring 13 and the ring member 21 to be held as a one-piece structure with the chuck 17, permitting them to be inserted into the outer sleeve 11 in a safe and secured manner.

Effect of the Invention

In the stick-like feeding container of the present invention, the ring member is interposed between the front end of the spring and the front spring shoe, and the elastic pieces extending along the stick-like object are linked at their rear ends to the ring member and carry at their front ends abutments configured to contact with the stick-like object by the elasticity of the elastic pieces, so that even if the outer sleeve is constructed from a relatively high rigidity resin or metal, the use of appropriately elastic resin or the like to form the ring member and the elastic pieces will enable the elastic pieces to urge, by their own elasticity, abutments to contact with the stick-like object with an appropriate pressure. Furthermore, variations in the size of the stick-like object 16 could be accommodated by the flexibility of the elastic pieces 22, enabling the abutments 23 to be urged to contacted with the stick-like object with an appropriate pressure at all times.

In this instance, the engaging pieces are provided on the inner sleeve or the chuck with the ring member fitted thereon to prevent the ring member from moving forward, and the spring is fitted on the chuck and then the ring member is fitted thereon from the front thereof to engage the ring member 12 with the engaging pieces 24, by which the ring member 21 can be held around the chuck 17 along with the spring 13. Accordingly, the spring 13 and the ring member 21 form a one-piece structure, and hence they can be inserted into the outer sleeve in a single step, enabling the stick-like object feeding container to be assembled relatively easily.

EXPLANATIONS OF LETTERS OR NUMERALS

Figure 1:
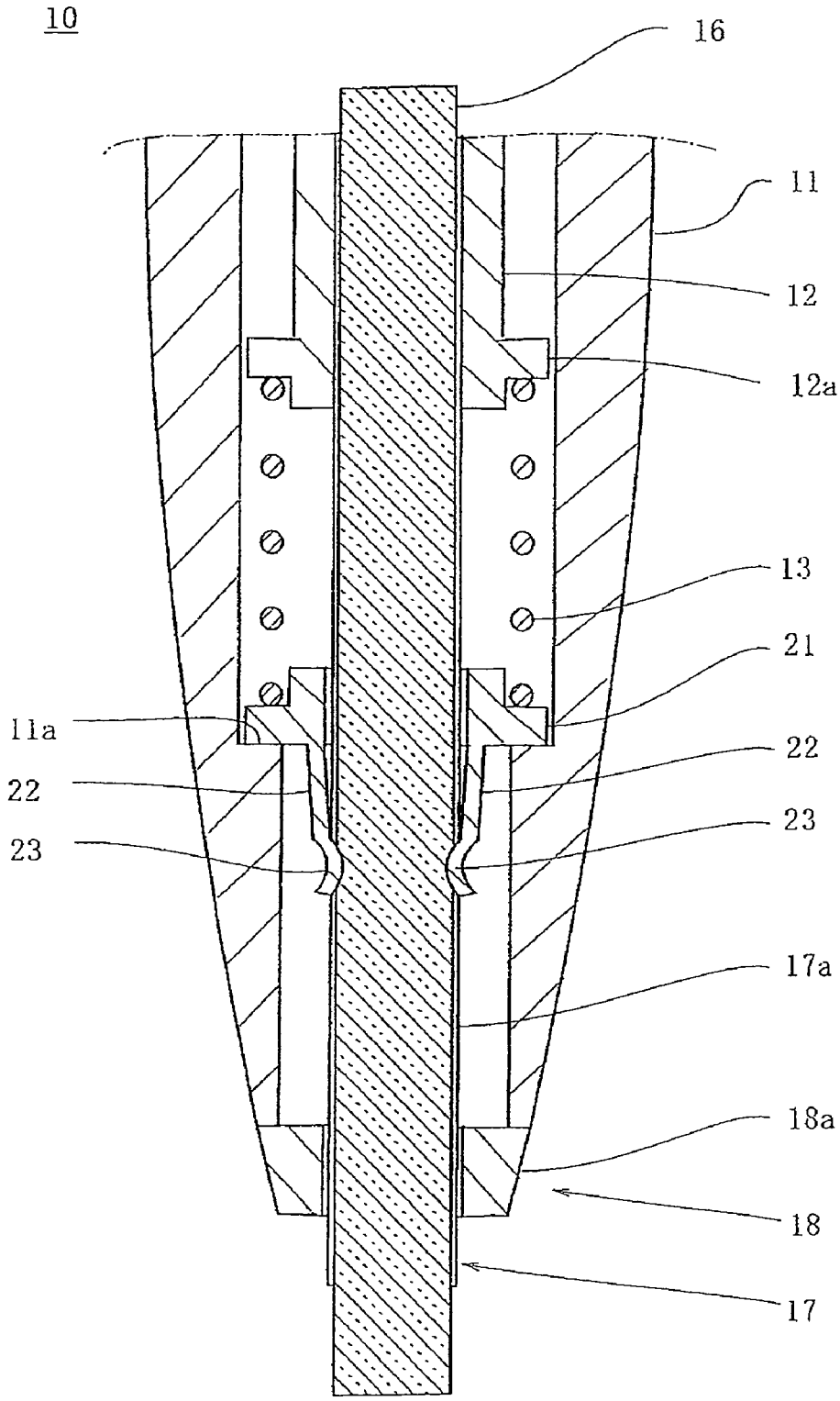
FIG. 1 is a longitudinal-sectional view taken along the line A-A in FIG. 7, showing the front end portion of a stick-like object feeding container according to an embodiment of the present invention.
Figure 2:
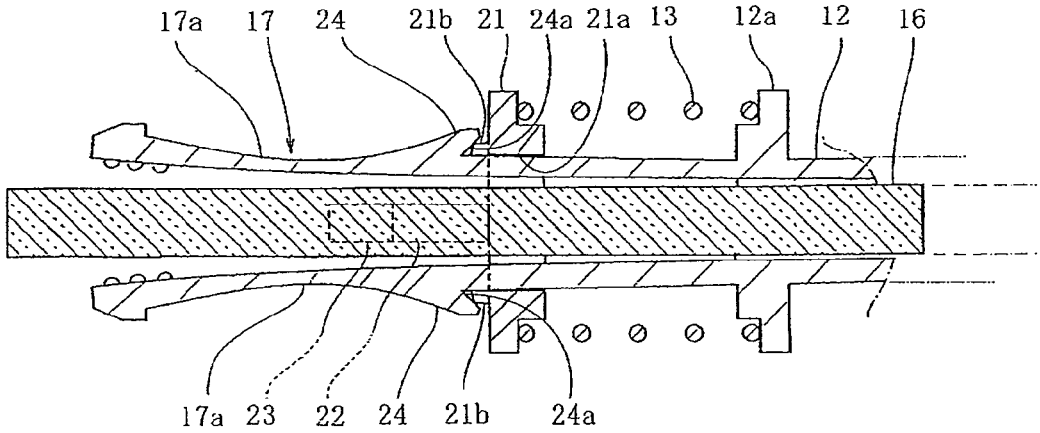
FIG. 2 is a longitudinal-sectional view taken along the line B-B in FIG. 5, showing the state in which a ring member is engaged with engaging pieces.

10: Stick-like object feeding container
11: Outer sleeve
11*a*: Front spring shoe
12: Inner sleeve
12*a*: Rear spring shoe
13: Spring

16: Stick-like object
17: Chuck
17*a*: Gripping pieces
18: Chuck ring
21: Ring member
21*b*: Projections
22: Elastic pieces
23: Abutments
24: Engaging pieces
24*a*: Recesses

BEST MODE FOR CARRYING OUT THE INVENTION

Next, a description will be given, with reference to the drawings, of the best mode for carrying out the present invention.

Figure 5:
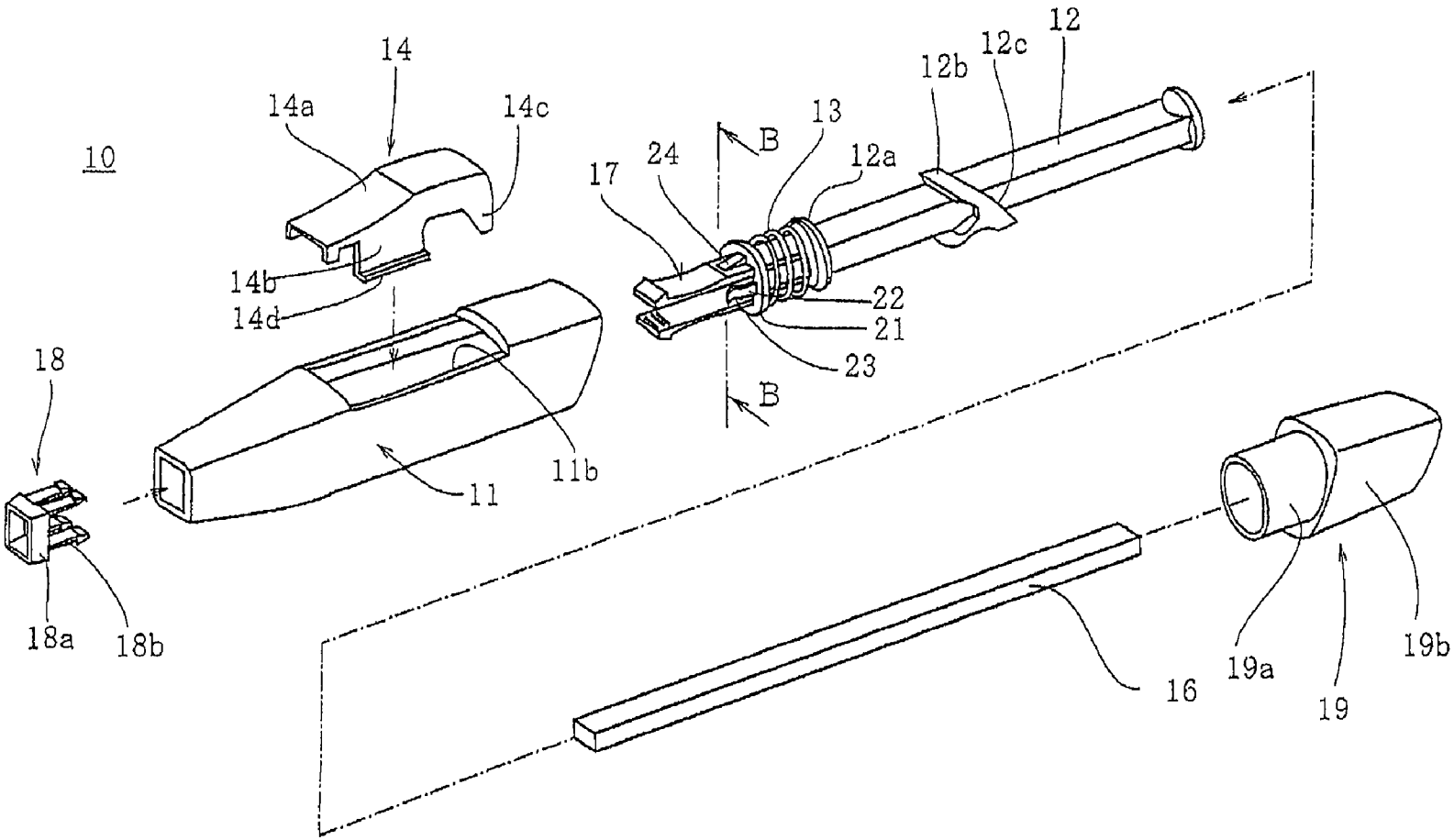
FIG. 5 is an exploded perspective view showing how to assemble the stick-like object feeding container.
Figure 6:
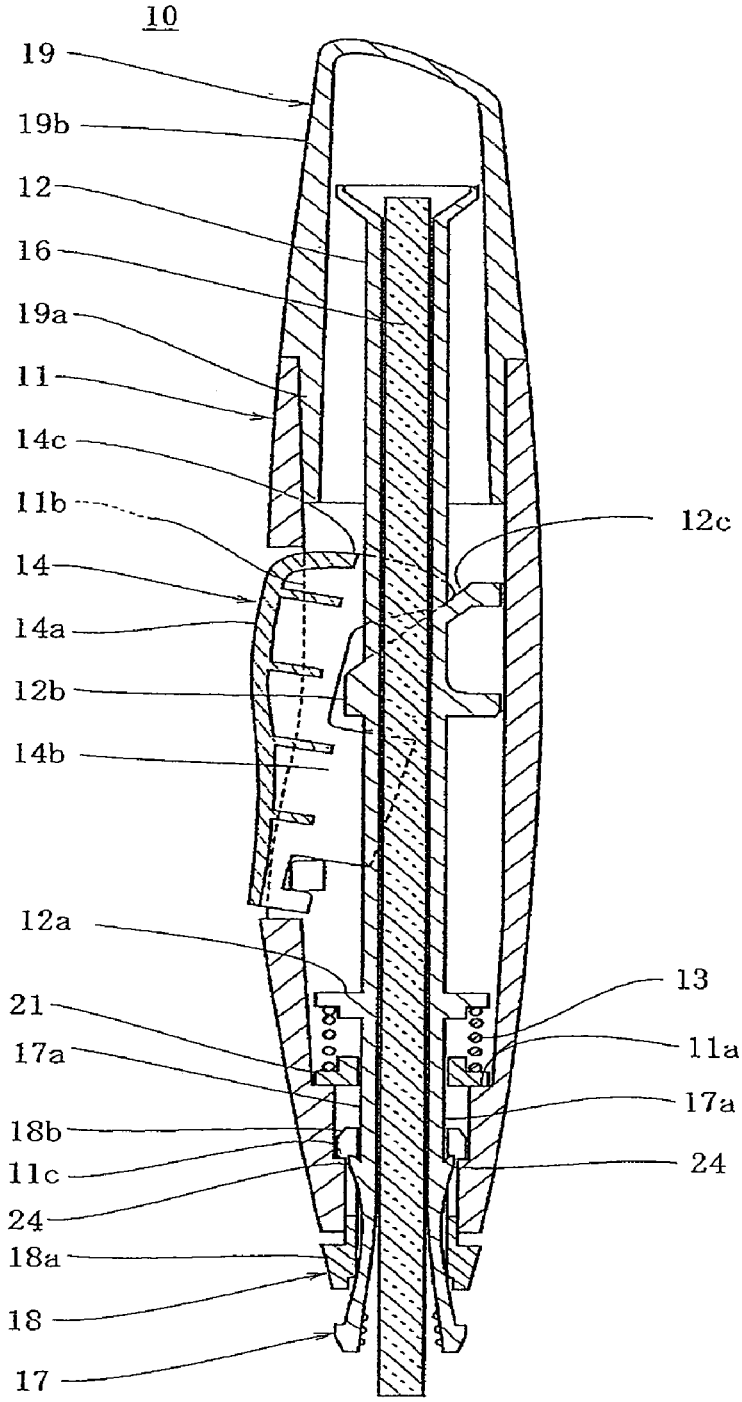
FIG. 6 is a longitudinal-sectional view showing the state in which an inner sleeve of the stick-like object feeding container has moved forward.
Figure 7:
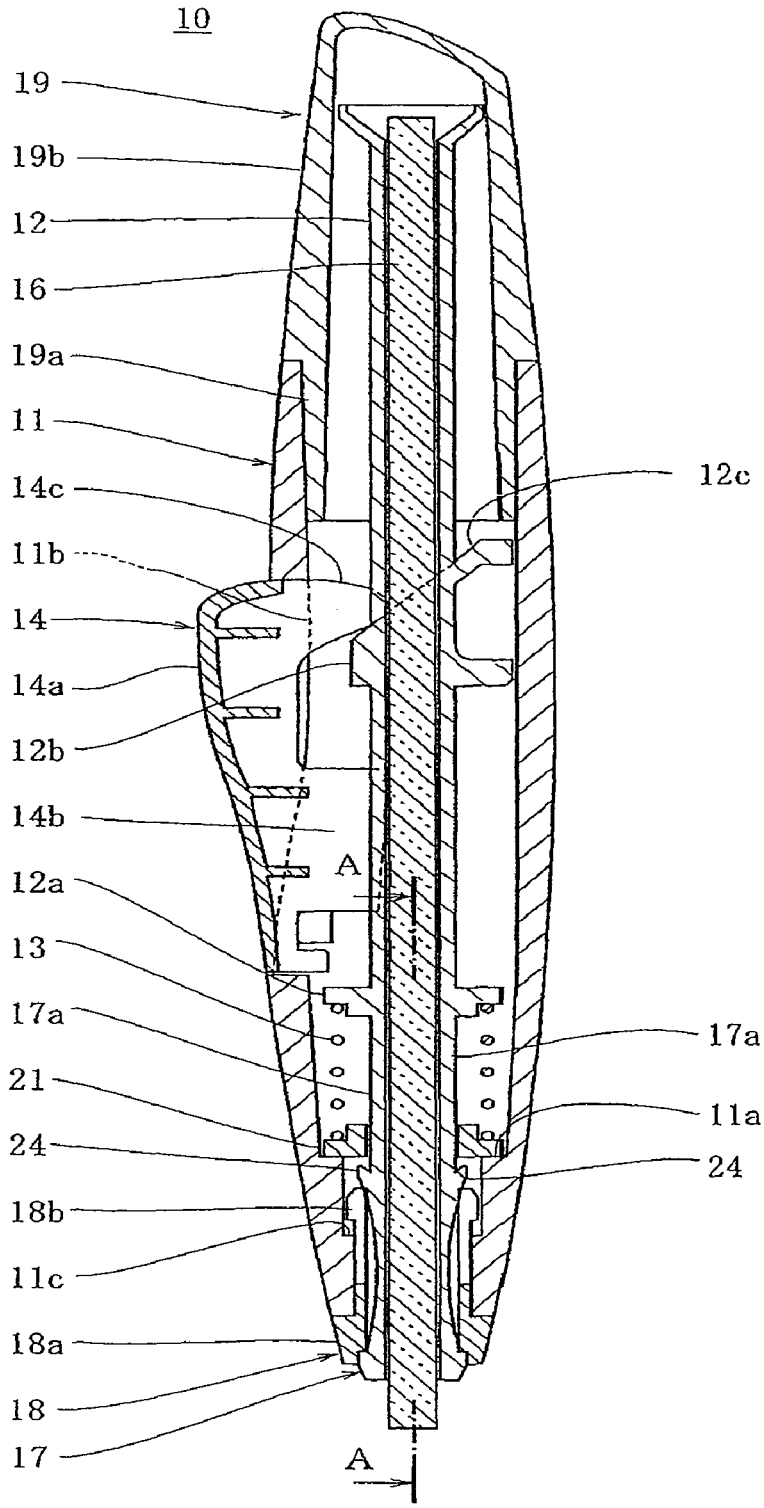
FIG. 7 is a longitudinal-sectional view showing the state in which the inner sleeve of the stick-like object feeding container has moved backward.

As depicted in FIG. 5 through 7, the stick-like object feeding container 10 according to the present invention is provided with: an outer sleeve 11; an inner sleeve 12 slidably inserted into the outer sleeve 11; and a spring 13 for biasing the inner sleeve 12 in a backward direction. The outer sleeve 11 is a molded part comprised of a relatively rigid resin, the interior surface of its front portion being provided with a shoulder to form a front spring shoe 11*a*. The feeding container 10 of this embodiment is what is called a side-knock type wherein axial movement of the inner sleeve 12 is performed by a knocking member 14 mounted on the outer sleeve 11 intermediately of the latter, the outer sleeve 11 has a knocking member receiving hole 11*b* made in its intermediate portion into which the knocking member 14 is inserted sidewise.

The inner sleeve 12 is constructed from a resin whose stiffness is equal to or slightly lower than in the case of the outer sleeve 11, and is configured into tubular form which permits the insertion thereinto a stick-like object 16. The stick-like object 16 is an eraser shaft, pencil lead shaft, crayon pencil shaft, pastel pencil shaft, eyebrow pencil shaft, or the like, which is square in cross section. The inner sleeve 12 has an axially extending, squarely-sectioned through hole slightly larger than the cross section of the stick-like object 16. The rear end portion of the inner sleeve 12 is funnel-shaped for easy insertion of the stick-like object 16 into the through hole. On the outer peripheral surface of the inner sleeve 12 a rear spring shoe 12*a* projecting outward is provided which, when inserted into the outer sleeve 11, will be located backward of the front spring shoe 11*a* of the outer sleeve 11. Moreover, the inner sleeve has a portion with a large diameter 12*b* at a position opposite to the knocking member receiving hole 11*b* when the inner sleeve is inserted into the outer sleeve, and the rear edge of the portion with a large diameter 12*b* is provided with a slope 12*c*. The slope 12*c* declines rearward in a direction away from the knocking member receiving hole 11*b* of the outer sleeve 11.

At the front end of the inner sleeve 12, a chuck 17 comprising a plurality of gripping pieces 17*a* is formed integrally with the inner sleeve 12. The chuck 17 in this embodiment is comprised of the pair of gripping pieces 17*a*, 17*a* which grip the stick-like object 16 with their front end portions, the rear ends of the plurality of gripping pieces 17*a*, 17*a* being formed continuously with the front end of the inner sleeve 12. A spring 13 is a coiled spring, and the coiled spring 13 is fitted onto the chuck 17 from the front thereof until the rear end of the spring comes into abutment with the rear spring shoe 12*a* of the inner sleeve 12. Then, the chuck 17 with the coiled spring 13 fitted thereon is inserted into the outer sleeve 11 from behind together with the inner sleeve 11. Thereby, the coiled spring 13 abuts at its front end against the front spring shoe 11*a* of the outer sleeve 11 and at its rear end against the rear spring shoe 12*a* of the inner sleeve 12. The coiled spring 13 is configured to bias the inner sleeve 12 backward by its expansive force relative to the outer sleeve 11.

A chuck ring 18 is fitted onto the chuck 17 projecting from the front end of the outer sleeve 11. The outer sleeve 11 has a step portion 11*c* for a stopper formed on the interior surface of its front portion for engagement with the chuck ring 18. The chuck ring 18 is comprised of a main ring body 18*a* formed by a square-sectioned ring, and engaging legs 18*b* extending rearward of opposite sides of the main ring body 18*a* for engagement with the engaging step portion 11*c*. The chuck ring 18 is attached to the front end of the outer sleeve 11 by inserting the engaging legs 18*b* into the outer sleeve 11 from the front thereof until they engage with the step portion 11*c* after fitting the main ring body 18*a* onto the chuck 17. The chuck ring 18 is adapted such that, as shown in FIG. 7, upon backward movement of the chuck 17 by the action of the coiled spring 13, the main ring body 18*a* is positioned at the front end of the chuck 17 to close it. On the other hand, when the chuck 17 moves forward together with the inner sleeve 12 against the biasing force of the coiled spring 13, the chuck ring 18 moves forward together with the chuck 17 until the rear ends of the engaging legs 18*b* engage with the step portion 11*c* as shown in FIG. 6. After engagement of the rear ends of the engaging legs 18*b* with the step portion 11*c*, the chuck ring 18 stays there, and when the chuck 17 is further advanced, the front end of the chuck 17 protrudes forward of the main ring body 18*a*, thereby opening its front end portion gripping the stick-like object 16.

With the inner sleeve 12 inserted into the outer sleeve 11, a cap 19 is mounted on the rear end of the outer sleeve 11 to close it. The cap 19 has a press-fit portion 19*a* to be press-fitted into the rear portion of the outer sleeve 11 and a main cap body 19*b*, and is configured such that when the press-fit portion 19*a* is press-fitted into the rear portion of the outer sleeve 11, the main cap body 19*b* closes the rear portion of the outer sleeve 11 with its outer surface smoothly contiguous to that of the outer sleeve 11.

With the inner sleeve 12 inserted into the outer sleeve 11, the knocking member 14 is fitted into the knocking member receiving hole 11*b* of the outer sleeve 11 in a manner to be depressible. The knocking member 14 comprises a main body 14*a* which extends along the outer sleeve 11 lengthwise thereof and stands out from the outer sleeve 11, a pair of side walls 14*b* extending downward of opposite sides of the main body 14*a*, and a knocking lever 14*c* extending rearward of the pair of side walls 14*b*. As depicted in FIG. 5, the side walls 14*b* have their lower marginal edges protruded outward to form flange-like hooks 14*d* for engagement with marginal edges of the knocking member receiving hole 11*b*, and the hooks 14*d* are engaged with the marginal edges of the knocking member receiving hole 11*b* by inserting the knocking member into the knocking member receiving hole 11*b* with the side walls 14*b* bent inward so as to move toward each other and then releasing them. The knocking member 14 is mounted in the knocking member receiving hole 11*b* in a depressible fashion, with the hooks 14*d* held in engagement with the marginal edges of the hole 11*b*.

As shown in FIGS. 6 and 7, the knocking lever 14*c* of the knocking member 14 is configured so that the tip of the knocking lever 14*c* abuts against the slope 12*c* of the portion with a large diameter 12*b* of the inner sleeve 12. More specifically, as depicted in FIG. 7, when the inner sleeve 12 moves backward to grip the stick-like object 16 by the front end portion of the chuck 17 under the action of the chuck ring 18, the tip of the knocking lever 14 abuts against the slope 12*c* formed on the inner sleeve 12, causing the knocking member 14 to protrude from the outer sleeve 11. On the other hand, as shown in FIG. 6, when the inner sleeve 12 moves forward to open the front end portion of the chuck 17, the tip of the knocking lever 14*c* abuts against the slope 12*c* formed on the inner sleeve 12, bringing the knocking member 14 into its depressed position. Thus, by depressing the knocking lever 14 into the outer sleeve 11 as depicted in FIG. 6 from its laterally protruded state as depicted in FIG. 7, the knocking lever 14*c* is pressed against the slope 12*c*, allowing the inner sleeve 12 to move forward along the slope 12*c* as shown in FIG. 6.

The structural feature of the present invention resides in that a ring member 21 is interposed between the front end of the coiled spring 13 and the front spring shoe 11*a* of the outer sleeve 11 and that the ring member 21 has elastic pieces 22 extending therefrom along the stick-like object 16. As shown in FIGS. 1 through 5, the ring member 21 and the elastic pieces 22 are formed integrally by molding an elastic resin so that the elastic pieces 22 are coupled at their rear ends to the ring member 21. The ring member 21 has a centrally-disposed, square through hole 21*a* into which the chuck 17 can be loosely fitted, and the elastic pieces 22 are disposed in such a manner as to extend outside along the stick-like member 16 which is gripped between a pair of gripping pieces 17*a*, 17*a* forming the chuck 17. The elastic pieces 22 have their front ends formed as abutments 23 for contact with the stick-like object 16. As depicted in detail in FIG. 1, the abutments 23 are formed integrally with the elastic pieces 22, by curving the front ends of the elastic pieces 22, 22 toward the stick-like object 16. The elastic pieces 22 having the abutments 23 formed at their front ends are each adapted to elastically contact the abutment 23 with the stick-like object 16.

Figure 3:
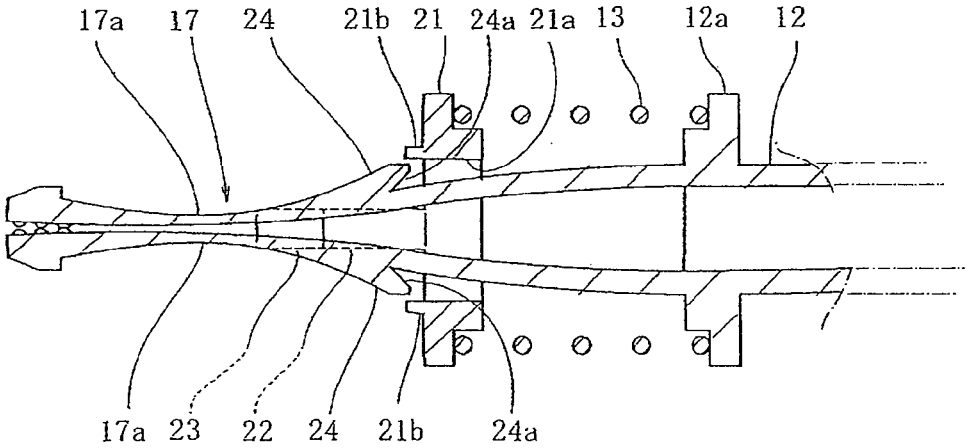
FIG. 3 is a longitudinal-sectional view corresponding to FIG. 2, showing the state in which the ring 21 is disengaged from the engaging pieces by the movement toward each other.
Figure 4:
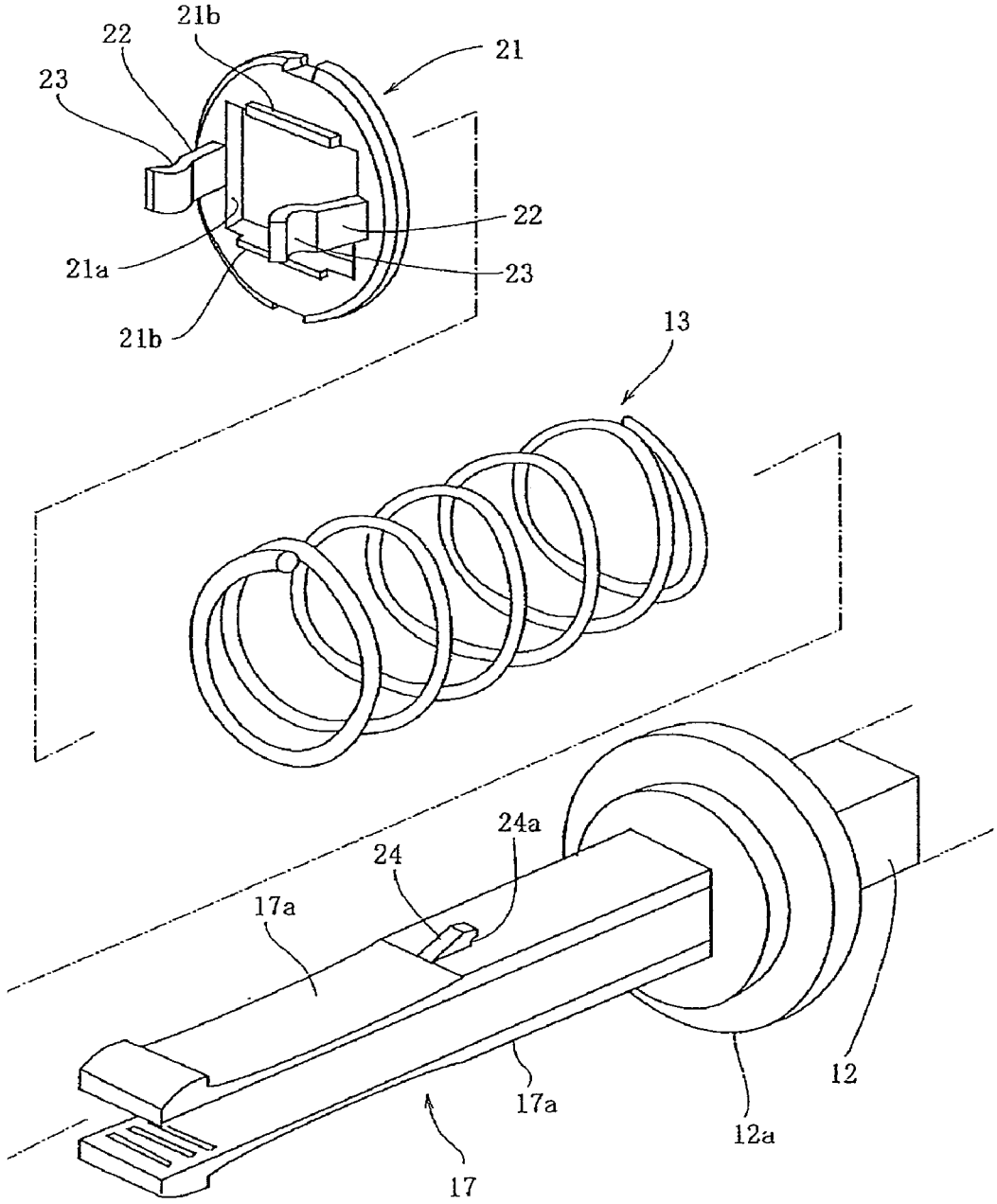
FIG. 4 is an exploded perspective view showing the state of fitting the ring member onto a chuck together with a spring.

As depicted in FIG. 4, the ring member 21 is fitted onto the chuck 17 from front after having the coiled spring 13 fitted onto the chuck, and each of the pair of gripping pieces 17*a*, 17*a* forming the chuck 17 has an engaging piece 24 provided on the outer surface thereof for preventing the ring member 24 from moving forward by the biasing force of the coiled spring 13. The engaging pieces 24 are configured so that they engage with marginal edges of the centrally-disposed, square hole 21*a* of the ring member 21 from the front thereof to prevent the ring member 21 from moving forward. As shown in FIG. 3, the pair of gripping pieces 17*a*, 17*a* grips the stick-like object 16 between their front end portions, so in the absence of the stick-like object therebetween the griping pieces 17*a*, 17*a* get closer to each other, and consequently the engaging pieces 24 formed on the pair of gripping pieces 17*a*, 17*a* disengage from the marginal edges of the hole of the ring member 21, releasing the ring member 21 from the state of being locked by the engaging pieces 24.

On the other hand, the ring member 21 has projections 21*b* protruding forward of a pair of opposed marginal edges of the through hole of the ring member 21, and the engaging pieces 24 for engagement with marginal edges of the ring member 21 have recesses 24*a* for engagement with the projections 21*b*. Further, as shown in detail in FIG. 2, it is provided that upon engagement of the projections 21*b* with the recesses 24, the movement of the gripping pieces 17*a*, 17*a*, having formed thereon the engaging pieces 24, toward each other is restricted. Also, the coiled spring 13 always biases the ring member 21, by which the projections 21*b* of the ring member are urged to engage with the recesses 24*a*. This excludes the possibility that the ring member 21 is released from the state of being locked by the engaging pieces 24 due to accidental inward movement of the griping pieces 17*a*, 17*a* toward each other.

Next, a description of the procedure for producing the stick-like object feeding container is given.

As illustrated in FIG. 4, the procedure starts with assembling the spring 13 and the ring member 21 with the chuck 17 into a one-piece structure. That is, the coiled spring 13 is fitted onto the chuck 17 from the front thereof until the rear end of the spring comes into abutment against the rear spring shoe 12*a*. Following this, the ring member 21 is fitted onto the chuck 17 from the front thereof until it comes into abutment against the front end of the coiled spring 13. Then, the ring member 21 is moved backward against the biasing force of the coiled spring 13 until the former passes over the engaging pieces 24. In this instance, since the engaging pieces 24 are formed on the pair of gripping pieces 17*a*, 17*a*, the movement of the gripping pieces 17*a*, 17*a* toward each other permits backward movement of the ring member 21 over the engaging pieces 24. Upon the ring member 21 passing over the engaging pieces 24, the pair of gripping pieces 17*a*, 17*a* return to their initial positions, and consequently, the engaging pieces lock the ring members 21, inhibiting forward movement of the ring member 21. This enables the spring 13 and the ring member 21 with the chuck 17 to be assembled into a one-piece structure.

Thereafter, as shown in FIG. 5, the chuck 17 assembled with the spring 13 and the ring member 21 into one-piece is inserted into the outer sleeve 11 from behind until the front end portion of the chuck 17 projects from the front edge of the outer sleeve 11. Then, the chuck ring 18 is fitted onto the front end portion of the chuck 17 projecting from the front end of the outer sleeve 11. In this case, the gripping pieces 17*a*, 17*a* forming the chuck 17 are moved toward each other to make their tip end portions narrow, and the chuck ring main body 18*a* of the chuck ring 18 is fitted onto the thus narrowed tip end portion of the chuck. Then, the engaging legs 18*b* of the chuck ring 18 are inserted into the outer sleeve 11 from the front thereof for engagement with the step portions 11*c*. In this way, the chuck ring 18 is attached to the front end of the outer sleeve 11.

Thereafter, the stick-like object 16 is inserted into the inner sleeve 12 through the rear end opening of the outer sleeve 11, after which the rear end of the outer sleeve 11 is closed by the cap 19. This is followed by mounting the knocking member 14 in the knocking member receiving hole 11*b* of the outer sleeve 11 so that the knocking member can be depressed. In this case, the hooks 14*d* are engaged with the marginal edges of the knocking member receiving hole 11*b* by inserting the knocking member into the hole 11*b* with the side walls 14*b* bent inward so as to be moved toward each other, and then releasing them. This is the final step for producing the stick-like object feeding container shown in FIG. 7.

While assembling of the stick-like object feeding container 10 involves insertion of the ring member 21 and the spring 13 into the outer sleeve 11, in the present invention, the ring member 21 is engaged with the engaging pieces 24, and the ring member 21 is fitted onto the chuck 17 along with the spring 13 to form a one-piece structure. Accordingly, the spring 13 and the ring member 21 can be inserted into the outer sleeve 11 together with the chuck 17, by a relatively simple work of only inserting the chuck 11, assembled with the ring member and the spring into a one-piece structure, into the outer sleeve 11. That is, these components can be inserted into the outer sleeve at one time, permitting the stick-like object feeding container 10 to be assembled relatively easily.

Next, a description of the operation of the stick-like object feeding container with the above construction will be given.

When the knocking member 14 is depressed into the outer sleeve 11 as depicted in FIG. 6 from the state of protruding laterally from the outer sleeve 11 as depicted in FIG. 7, the knocking lever 14*c* is pressed against the slope 12*c* and the inner sleeve 12 moves forward along the slope 12*c*. As the inner sleeve 12 moves forward, the chuck 17 gripping the stick-like object 16 also moves forward, to feed out the stick-like object 16. Following this, when the rear ends of the engaging legs 18*b* of the chuck ring 18 engage with the step portions 11*c*, the chuck ring 18 stays at its current position, and by further forward movement of the chuck 17 the front end portion of the chuck 17 gripping the stick-like object 16 is opened. As a result, the stick-like object 16 is fed out forward. In this instance, the abutments 23 keep contacting with the stick-like object 16 by frictional resistance to prevent the stick-like object 16 from falling off upon opening of the chuck 17.

Upon releasing the pressure applied to the knocking member 14, the inner sleeve 12 is returned backward by the spring force of the coiled spring 13. The chuck 17 with its front end opened moves backward together with the chuck ring 18 until the ring main body 18*a* of the chuck ring 18 abuts against the front end edge of the outer sleeve 11, and after abutment of the ring main body 18*a* against the front end edge of the outer sleeve 11, only the chuck 17 moves backward until the ring main body 18*a* is fitted onto the front ends of the pair of gripping pieces 17*a*, 17*a* forming the chuck 17 to close the front ends, and the front end portions grip again the stick-like object 16 which has been fed out forward to inhibit their movement in the axial direction. At this time, the abutments 23 contact with the stick-like object 16 to prevent, by the frictional resistance caused by the contact between them, the stick-like object 16 which has been fed out forward from being pulled back when chuck 17 moves backward to return from the opened state to the closed state.

In this instance, the abutments 23 for contact with the stick-like object 16 are formed integrally with the ring member 21 and the elastic pieces 22 which are provided independently of the outer sleeve 11, so even if the outer sleeve 11 is formed of a relatively rigid resin or metal, the abutments 23 could be urged to contact with the stick-like object 16 with an appropriate pressure by constructing the ring member 21 and the elastic pieces 22 from an appropriately elastic resin or the like. Also, since the elastic pieces 22 elastically bring the abutments 23 into contact with the stick-like object, possible variations in the size of the stick-like object 16 could be accommodated by the flexibility of the elastic pieces 22, ensuring that the abutments are always urged to contact with the stick-like object 16 with an appropriate pressure. In addition, since the ring member 21 and the elastic pieces 22 are provided independently of the outer sleeve 11, there is no need for forming slits or the like in the outer sleeve 11 as in the prior art. Therefore, it is possible to effectively avoid the possibility of the external appearance being seriously spoiled.

On the other hand, stick-like object 16 which has been fed out forward is retracted by depressing the knocking member 14 to move the inner sleeve 12 forward in axial direction against the biasing force of the spring 13 to open the chuck 17 and pushing the stick-like object 16 at the front end thereof against the frictional resistance caused by the contact of the abutments 23 with the stick-like object 16.

Moreover, in order to newly provide a stick-like object, the cap 19 is removed from the outer sleeve 11 and the stick-like object 16 is inserted into the inner sleeve 12 through the rear end opening. This is followed by closing again the rear end of the outer sleeve 11 with the cap 19 to complete the work of newly providing the stick-like object 16.

Figure 8:
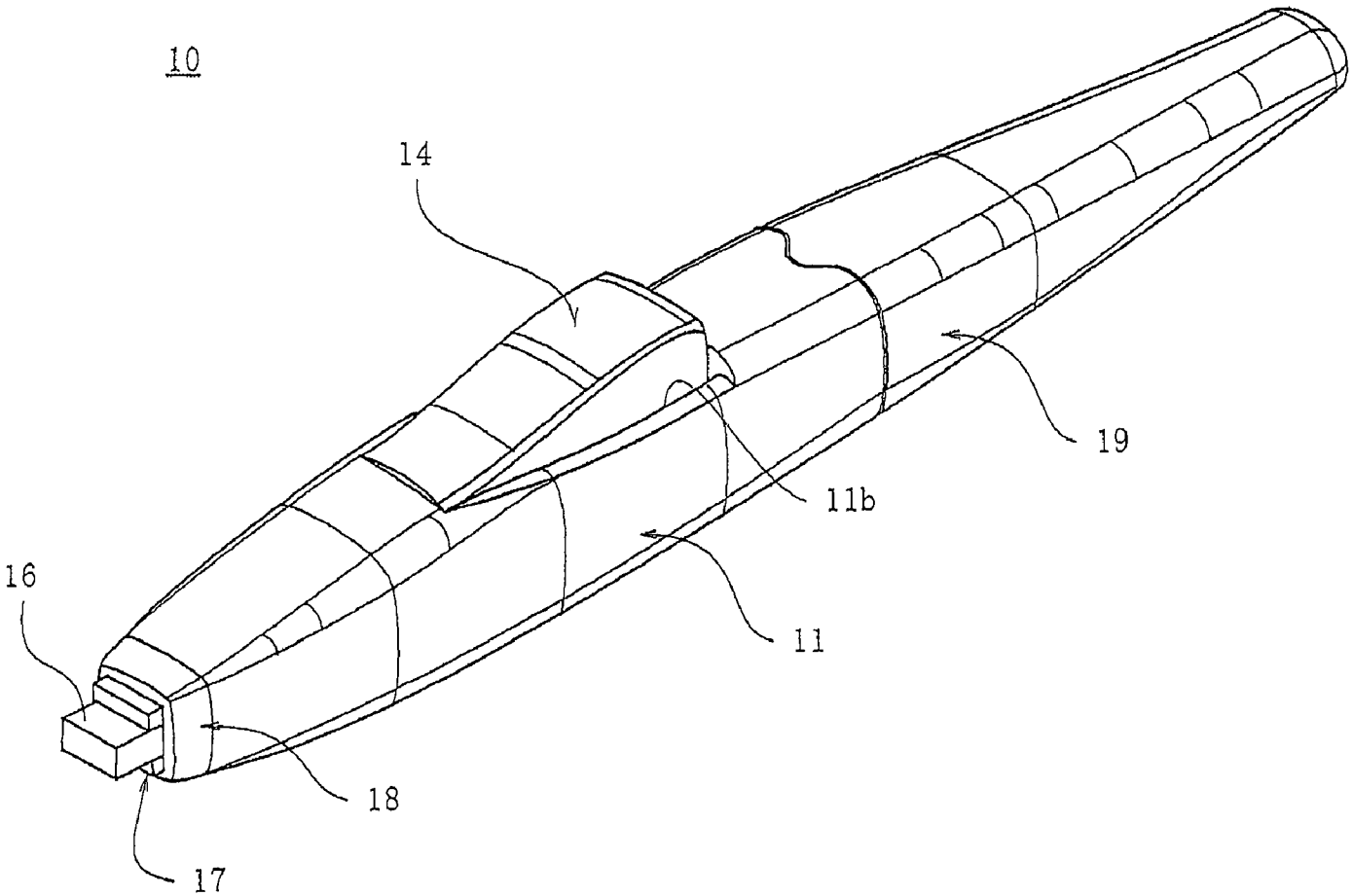
FIG. 8 is a perspective view of a stick-like object feeding container using a relatively long cap.

Furthermore, since the rear end of the outer sleeve 11 is closed by the cap 19, if plural kinds of caps 19 with different configurations are prepared, it is possible to obtain plural kinds of stick-like object feeding containers with different external appearances by a relatively simple work of exchanging the cap 19 for a desired one of the caps. For example, FIGS. 6 and 7 show in cross section the stick-like object feeding container 10 using a relatively short cap 19 to close the rear end of the outer sleeve 11, whereas FIG. 8 is a perspective view of a stick-like object feeding container 10 using a relatively long cap 10 to close the rear end of the outer sleeve 11. Thus, the impression of the container obtained from the whole appearance thereof readily changes only by the change of the shape of the cap 19, so it can be expected to arouse different demands by a simple work of only exchanging the caps 19.

Incidentally, while in the above embodiments what is called the side-knock-type stick-like object feeding container is described, wherein the movement of the inner sleeve 12 in the axial direction thereof is performed by the knocking member 14 disposed intermediately of the outer sleeve 11, the container may also be what is called a rear-knock-type stick-like object feeding container which is not shown, wherein the rear end of the inner sleeve is protruded from the rear end of the outer sleeve and the rear end of the inner sleeve is pressed forward to move it in the forward direction.

In addition, while in the embodiments above the stick-like object 16 has been described to be square in cross section, the stick-like object may be circular, triangular, pentagonal, or in other polygonal shapes in cross section. In this instance, the cross section of the inner sleeve 12 will be chosen in conformity with the cross-sectional shape of the stick-like object used.

Additionally, while the chuck 17 has been described to comprise the pair of gripping pieces 17*a*, 17*a*, the number of gripping pieces 17*a* may be three, four, or five so long as they can grip the stick-like object at their front end portions. In such an instance, the front end portions of the gripping pieces 17*a* for gripping the stick-like object will be configured in conformity to the outer shape of the stick-like object 16.

The invention claimed is:

1. A stick-like object feeding container comprising;

an outer sleeve having a front spring shoe formed on the interior surface of the front portion of said outer sleeve;

an inner sleeve slidably inserted into said outer sleeve and having a rear spring shoe formed on the exterior surface of said inner sleeve at a position backward of said front spring shoe;

a spring abutting at the front and rear ends thereof against said front spring shoe and said rear spring shoe, respectively, to bias said inner sleeve backward;

a chuck provided at the front end of said inner sleeve to grip the front end portion of said stick-like object inserted into said inner sleeve;

a chuck ring fitted onto said chuck and locked to the front end of said outer sleeve; and abutments for contact with said stick-like object inserted into said inner sleeve, wherein a ring member is interposed between the front end of said spring and said front spring shoe;

elastic pieces extending along said stick-like object are linked at rear end to said ring member;

said abutments are formed at the front end of said elastic pieces; and said elastic pieces are configured to elastically urge said abutments to contact with said stick-like object.

2. The stick-like object feeding container according to claim 1, wherein said inner sleeve or said chuck having fitted thereon said ring member includes engaging pieces for prevent said ring member from moving forward.

3. The stick-like object feeding container according to claim 2, wherein said chuck comprises a plurality of gripping pieces, said engaging pieces are formed on each of said gripping pieces, and said ring member is disengaged from said engaging pieces by the movement of said gripping pieces toward each other.

4. The stick-like object feeding container according to claim 3, wherein projections protruding forward are provided on the marginal edges of the hole of said ring member, and recesses with which said projections engage, are formed in said engaging pieces so that an engagement of said projections with said recesses prevents said plurality of gripping pieces from moving toward each other.

* * * * *